United States Patent [19]

Akkerman

[11] Patent Number: 4,605,064

[45] Date of Patent: Aug. 12, 1986

[54] WELL APPARATUS

[75] Inventor: Neil H. Akkerman, Houston, Tex.

[73] Assignee: AVA International Corp., Houston, Tex.

[21] Appl. No.: 708,536

[22] Filed: Mar. 5, 1985

Related U.S. Application Data

[63] Continuation of Ser. No. 536,278, Sep. 27, 1983, abandoned, which is a continuation-in-part of Ser. No. 489,827, Apr. 29, 1983, Pat. No. 4,522,259.

[51] Int. Cl.[4] ..... E21B 23/02

[52] U.S. Cl. ..... 166/237; 166/123

[58] Field of Search ..... 166/237, 217, 113, 123, 166/125, 322, 117.5, 381, 382; 285/39

[56] References Cited

U.S. PATENT DOCUMENTS

| | | | |
|---|---|---|---|
| 2,885,011 | 5/1959 | Frost | 166/123 |
| 3,211,230 | 10/1965 | Stone, Jr. | 166/123 |
| 4,284,137 | 8/1981 | Taylor | 166/123 X |

*Primary Examiner*—Stephen J. Novosad
*Assistant Examiner*—Thuy M. Bui
*Attorney, Agent, or Firm*—Vaden, Eickenroht, Thompson & Jamison

[57] ABSTRACT

There is disclosed well apparatus including a wire line running tool assembly on which a well tool may be lowered into a well conduit, and then locked within the well conduit, and released from the assembly, when it is so locked, in response to manipulation of the wire line, whereby the assembly may be retrieved.

42 Claims, 18 Drawing Figures

WELL APPARATUS

This application is a continuation of my copending application Ser. No. 536,278, filed Sept. 27, 1983, now abandoned and entitled "Well Apparatus", which in turn was a continuation in part of my copending application, Ser. No. 489,827, filed Apr. 29, 1983, now U.S. Pat. No. 4,522,259 and entitled "Well Apparatus".

This invention relates generally to apparatus of the type in which a well tool is to be lowered into and locked within a well conduit by the expansion of locking means carried by the well tool into a locking groove in the well conduit. More particularly, it relates to improved apparatus of this type in which the well tool is lowered into the well conduit by means of a wire line running tool which, when a shoulder on the well tool is engaged with a seat in the well conduit to locate the locking means opposite the groove may be manipulated to cause locking means to be expanded into the groove in the well conduit, and then, when the well tool is so locked, release the running tool from the well tool for retrieval from the well conduit.

Typically, the well conduit is a so-called landing nipple connected as a part of the well string and having a seal bore therein which, when the locking means is locked within the locking groove, is engaged by the seal means on the well tool, or another tool connected to and lowered with the well tool in order to close the well or otherwise control flow therethrough. Alternatively, the well tool to be locked within the nipple may be an instrument of some type which does not have seal means to engage the seal bore of the nipple.

In apparatus of this type prior to that of my aforementioned patent application, it was the practice to lock the well tool within the well conduit by means of collets, keys, dogs, or other locking means which were caused to expand in response to engagement of the well tool with a radial restriction within the well conduit. As noted in my prior application, if the well tool engaged a restriction in the well string other than one deliberately provided in the conduit for that purpose, it could be locked at some unintended location within the well string, and, in some cases, the running tool released from the well tool without the operator knowing that the well tool was not properly located.

For the purpose of overcoming these and other problems, the well tool shown and described in my prior application has sensing means movable into engagement with the seal bore or another, deliberately provided cylindrical bore in the nipple, as the well tool is lowered by means of a running tool into the well conduit, and means which is responsive to such movement of the sensing means for causing normally retracted locking means carried by the well tool to be expanded into the locking groove of the nipple, and, when the locking means is so expanded and upon further manipulation of the running tool for releasing the running tool from connection to the well tool to permit it to be retrieved from the well conduit. Thus, although there may be many cylindrical surfaces within a well string above the bore in the nipple to be sensed by the sensing means, the well tool cannot be locked and the running tool retrieved unless the intended cylindrical surface is sensed, provided of course that none are of a diameter deliberately provided for cooperation with the sensing means. As also disclosed in my prior application, the well tool is provided with means to which a wire line retrieving tool may be connected together with means responsive to raising of the retrieving tool, when so connected to the well tool, for causing the locking means to return to retracted position, whereby the well tool may be lifted from the well conduit with the retrieving tool.

Thus, the well tool includes means which is shiftable from a first position to a second position to cause the normally retracted locking means to be expanded into the locking groove, with the shiftable means being held in its first position, as the tool is lowered into the well conduit, and then released for shifting into its second position in response to movement of the sensing means into engagement with the cylindrical bore. More particularly, a means is provided for releasing the running tool from connection to the well tool, in response to shifting of the shiftable means to its second position, upon further manipulation of the running tool, whereby the running tool may be raised from the well tool.

In the illustrated embodiment of the well apparatus of my prior application, the well tool includes a first member adapted for connection to the running tool for lowering therewith into the well conduit, and a second member supported from the first member for relative vertical movement with respect to it. A locking means is carried by the second member for radial expansion and contraction with respect thereto, and a shoulder on the second member is adapted to land on a seat in the well conduit when the locking means is opposite the groove in the well conduit. The first member has a shoulder thereon for expanding the locking means into locking position, in response to continued downward movement of the first member relative to the second member, following release of the first member from connection to the second member when the sensing means carried by the second member is lowered into the cylindrical bore within the conduit.

Upon continued downward movement of the first member with respect to the second member so as to expand the locking means, the first member is held against upward movement which would permit retraction of the locking means, and the running tool is released from the first member to permit it to be retrieved from the well conduit. As shown in my prior application, the first member is so held by one or more pins carried by the second member for fitting within a groove about the first member and adapted to be sheared by an upward jar imparted to the first member, whereby the first member may be raised and the well tool retrieved.

The pin or pins are surrounded by a C-ring which urges them inwardly and thus into the groove when the first member has been lowered with respect to the second member to expand the locking means. Although in common use in other well tools, C-rings of this type may be too weak or otherwise not entirely reliable in maintaining the connection between the first and second members, and, in fact, the pins and/or the C-rings may even be left out during assembly of the tool. Also, and especially in view of the environment in which the tool is used, the groove may fill up with debris and thus not permit movement of the pins into connecting positions. Still further, even if the connection is made, vibration and/or corrosion may, over a period of time, cause the pins to fail and thus no longer connect the members in the intended manner. As a result of any one or more of these malfunctions, the first member may be inadvertently raised to release the locking means, due, for example, to upward flow of well fluid, raising of other well tools through the first member, or other circumstances beyond the control of the operator which might also impose an upward force on the first member.

Also, there is no way for the operator to know whether or not the first member is actually connected to the second member, and thus that the locking means is held in locked position. That is, continued lowering of the wire line following landing of the well tool in the well conduit, and subsequent release of the running tool, merely means that the first member has been lowered the desired distance, but not necessarily that the pins have engaged in the groove to connect the members to one another.

U.S. Pat. No. 4,315,544 shows other apparatus of this type in which the locking means is extended to be held in locking position by the shifting of lugs on the ends of collet fingers into a groove of the well tool. However, these lugs merely serve as detents in much the same manner as the above-described shear pins, and may be inadvertently moved out of the groove to release the locking means.

The primary object of this invention is to provide apparatus of this type in which the well tool is locked against such inadvertent release, and further in which the operator is given a positive indication that the locking means is in fact so locked.

Another object is to provide apparatus of the character described in the foregoing object in which the well tool may be retrieved, in the event of malfunction, in a relatively simple manner, and, more particularly, by means of apparatus including an assembly of running tools having alternate uses and functions in running, pulling and retrieving the well tool.

These and other objects are accomplished, in accordance with the illustrated embodiment of the invention, by well apparatus of the type above described wherein, upon further shifting in the one vertical direction, following expansion of the locking means into locking position, the shiftable means is locked against movement in the opposite vertical direction in response to a force in said opposite vertical direction. Thus, as compared with prior apparatus of this type wherein the shiftable means is instead held by shearable or other detent type mechanism, the well tool may not be inadvertently unlocked by conditions or circumstances within the well of the nature above discussed. More particularly, the apparatus also includes means which is automatically responsive to locking of the shiftable means for disconnecting the running tool from the well tool in order to permit retrieval of the running tool from the well conduit. Thus, if the running tool is so retrievable, the operator not only knows that the shiftable means has been moved to a position for causing the locking means to be locked within the groove of the well conduit, but also that the shiftable means is locked against movement in the opposite vertical direction in response to vertical forces in such opposite vertical direction.

Preferably, the shoulder of the well tool is landable on an upwardly facing seat in the well conduit, and thus against downward movement, and the shiftable means for causing the locking means to be expanded into the groove is shiftable downwardly, following landing of the shoulder of the seat. Thus, the well tool is landed in the conduit, the locking means is caused to expand into the groove, and the shiftable means is locked in response to continous lowering of the running tool, and thus, as noted in my prior application, without the need for jarring or other complex manipulation of the wire line.

In the illustrated and preferred embodiment of the invention, the well tool is of much the same construction as that of my prior application in that it comprises a body having a first member releasably connectible to a running tool for raising and lowering therewith, a second member supported by the first member for vertical movement with respect to it, and having the landing shoulder formed thereon, together with locking means carried by the second member for disposal opposite the groove in the well conduit when the shoulder is so landed on the seat in the well conduit. More particularly, the first member has means thereon for moving the locking means into locking position within the groove, in response to downward movement of the first member with respect to the second member, and the first and second members have parts thereon which are automatically movable into engagement with one another, upon further downward movement of the first member following expansion of the locking means into the locking position, so as to prevent upward movement of the first member in response to an upward force. More particularly a means is provided for disconnecting the running tool and first member, in order to permit retrieval of the running tool from the well conduit, in response to movement of such parts on the first and second members into engagement with one another.

In the illustrated embodiment of the invention, one of the members includes collet fingers having shoulders which are radially biased by the other member, as the first member is moved downwardly with respect to the second member, and the other member has an oppositely facing shoulder over which the shoulders on the collet fingers move, upon further downward movement of said first member, and following movement of the locking means into locking position. More particularly, the ends of the collet fingers which extend above the shoulders thereon also extend above the other member and thus are conveniently positioned for cooperating with means on the well tool to disconnect the running tool from the first member of the well tool in response to movement of the shoulders on the collet fingers into locking position. Thus, the running tool is connected to the first member by means of latches carried by the running tool and yieldably urged into a groove in the first member, and is disconnected from the first member by means of dogs which are pivotally mounted on the body of the running tool to dispose one end for engagement by the inner sides of the uppers ends of one or more of the collet fingers, so that, as they move into position to lock the first member against upward movement, the collet fingers pivot the dogs in a direction to move the latches out of latching position. Preferebly, a spring is arranged between each latch and the body of the running tool for not only yieldably urging the latch to latching position, but also urging the dog engaged by the latch to a position for engagement by a collet finger.

The well tool may be retrieved at some later date by another tool adapted to be lowered within the well bore and into connection with the first member following release and retrieval of the running tool assembly therefrom. More particularly, this retrieving tool has means thereon for not only connecting it to the well tool, when lowered onto it, but also for moving the collet fingers to unlocking position, as the tool is so lowered, whereby said first member may be raised to release the locking means and thereby permit the well tool to be retrieved with the other tool. More particularly, the retrieving tool has means thereon which moves the upper ends of the collet fingers in radial directions to positions in which the shoulders thereon are out of engagement with the shoulder on the first member.

In the preferred embodiment of the invention, the running tool assembly includes a pair of running tools, one of which is, as above described, connected to the well conduit, and the other of which is releasably connectible to a wire line for raising and lowering therewith and releasably connected to the one running tool whereby it may be retrieved in the event the first-mentioned running tool cannot be disconnected from the well tool. As will be described in the detailed description to follow, this need for releasing the second-mentioned tool and the wire line from the well may occur because of one or more malfunctions of the apparatus, other than the failure of the locking means of the tool to move into locking position or the failure of the collet fingers to move into locking positions, even though the locking means is in locking position. In these latter instances, of course, the entire well tool may be retrieved with the running tool assembly, and thus without the necessity for releasing the the two running tools, merely by lifting of the assembly with the wire line.

On the other hand, in the event of another malfunction, such as the failure of the collet fingers engageable by the dogs to move to locking position, due to an obstruction to movement of the locking dogs to latch retracting position, or upon breaking of the dogs such that they are incapable of moving the latches to unlatching position, the first-mentioned running tool would remain latched to the well tool, such that there is a need for retrieving it form the well bore, whether or not certain of the collet fingers have in fact moved to locking position. In this case, the other running tool the other running tool would be released from the first-mentioned running tool and retrieved with the wire line, and another tool is run into the well conduit for moving the collet fingers of the second member into unlocking position. More particularly, this other tool has means thereon for releasable connection with the first-mentioned running tool, together with means for so moving the collet fingers as it is so lowered into connection with the first-mentioned tool. Thus, the locking shoulders on all collet fingers have been to unlocking position, whereby, upon raising of the retrieving tool, the first-mentioned running tool and the first member of the well tool latched to it may be raised so as to release the locking means of the well tool. In the preferred and illustrated embodiment of the invention, the retrieving tool for this purpose may comprise the running tool which, as above described, has been retrieved from the first-mentioned running tool, and then redressed and provided with a sleeve for moving over the first-mentioned running tool to engage and move the upper ends of the collet fingers to unlocking position.

The invention also contemplates that, even if the absence of a malfunction which would require the emergency release of the second-mentioned running tool, the second-mentioned running tool could, following retrieval of both running tools, be redressed and subsequently lowered onto the well tool for the purpose of unlocking it and retrieving it from the well conduit. Thus, such other running tool includes, in addition to means for locking it to the first-mentioned running tool, a means for connecting it to the first member, when so lowered, and a radial enlargement for engaging the collet fingers to move them to unlocking position, whereby the well tool may be retrieved with the other running tool. In this case, of course, the first member of the well tool would have a groove preparation much like the groove preparation of the first-mentioned running tool for receiving latches of the second-mentioned running tool.

In the drawings, wherein like reference characters are used throughout to designate like parts:

Figure 1:
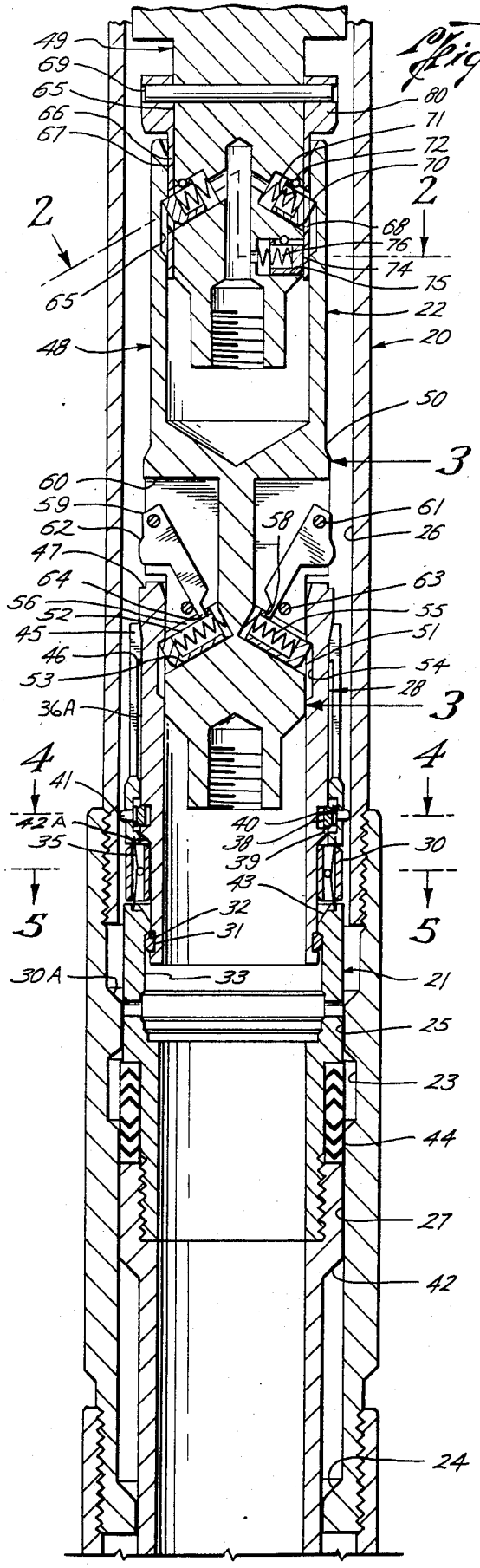
FIG. 1 is a vertical sectional view of well apparatus constructed in accordance with the present invention, including the well conduit in which the locking groove and landing seat are formed, and the well tool as it is lowered into the well conduit by means of the running tool assembly.
Figure 2:
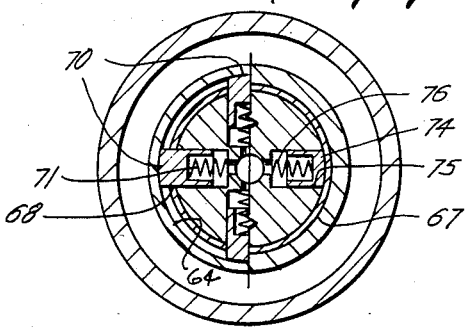
FIG. 2 is a cross sectional view of the apparatus, as seen along broken line 2—2 of FIG. 1, and showing the releasable connection of the running tools of the running tool assembly.
Figure 3:
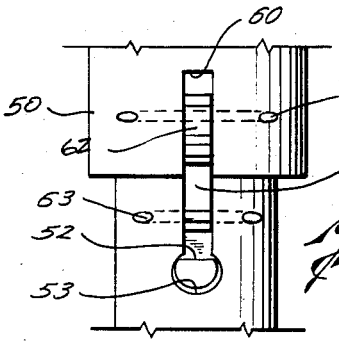
FIG. 3 is a side view of one of the running tools, as seen along broken lines 3—3 of FIG. 1.
Figure 4:
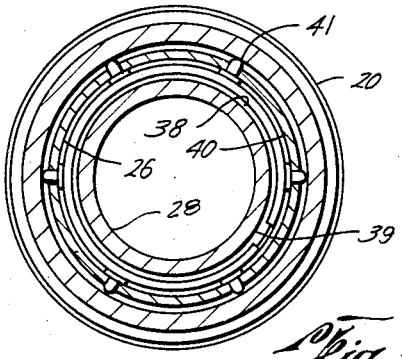
Figure 5:
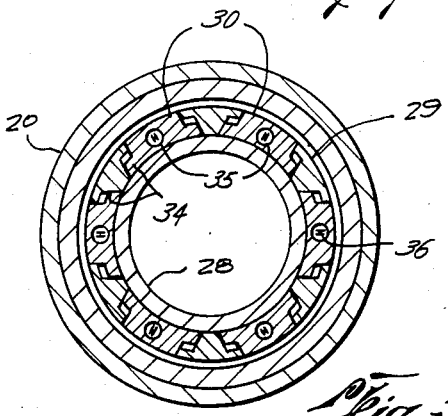
Figure 6:
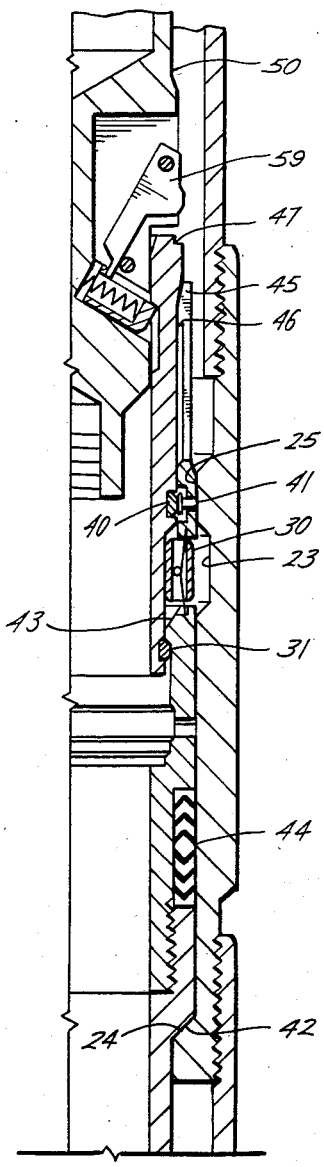
Figure 7:
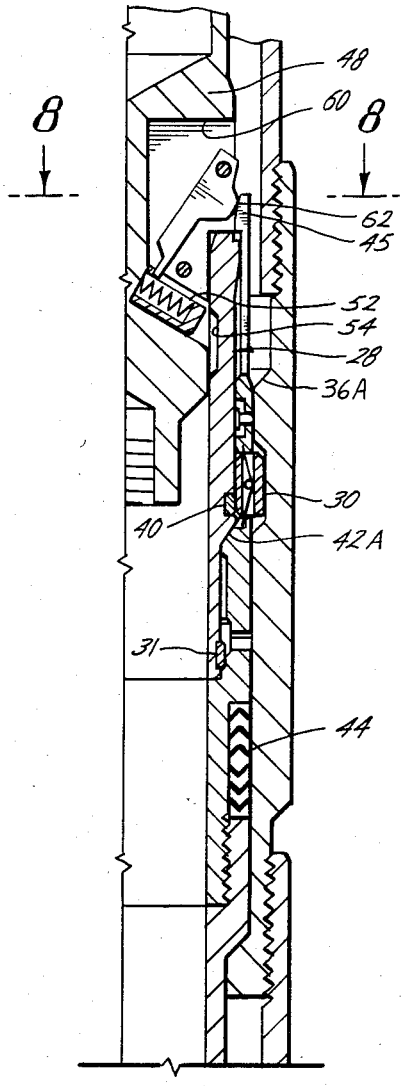
Figure 8:
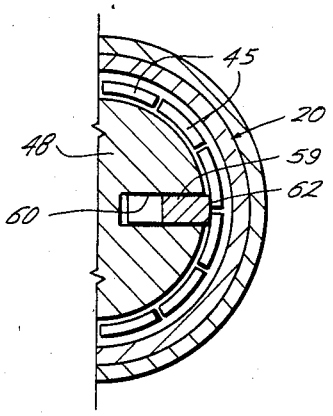
Figure 13:
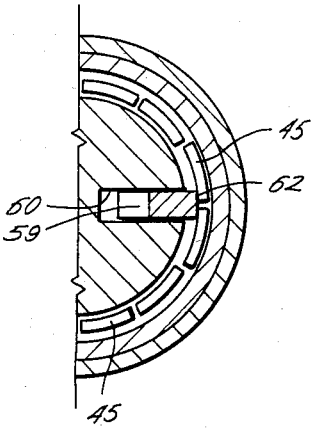
Figure 9:
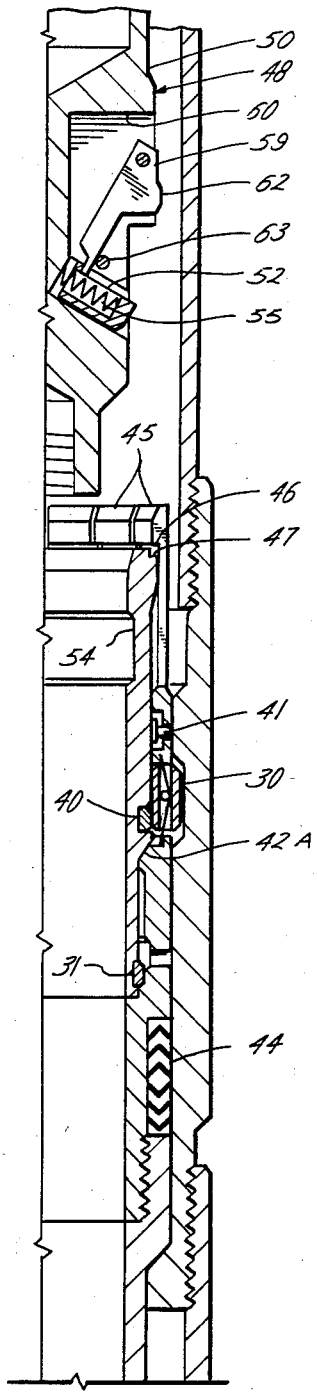
Figure 10:
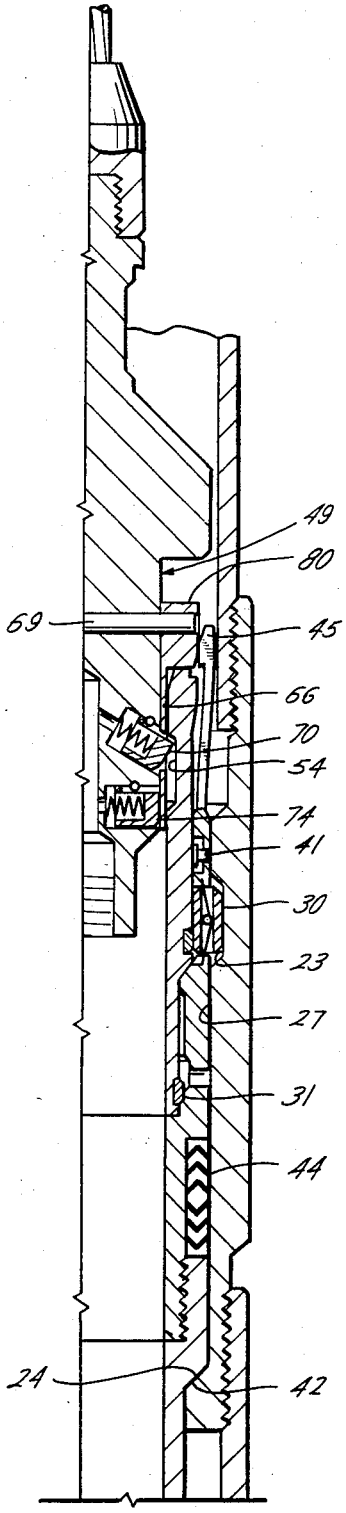
Figure 11:
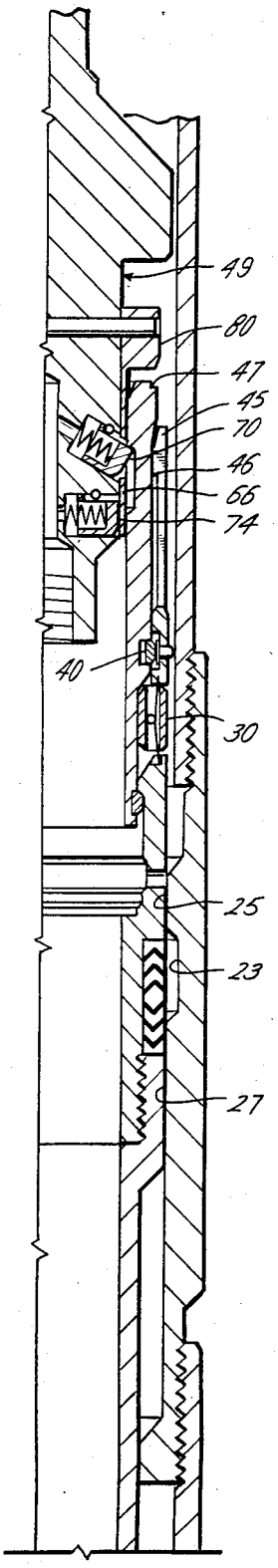
Figure 12:
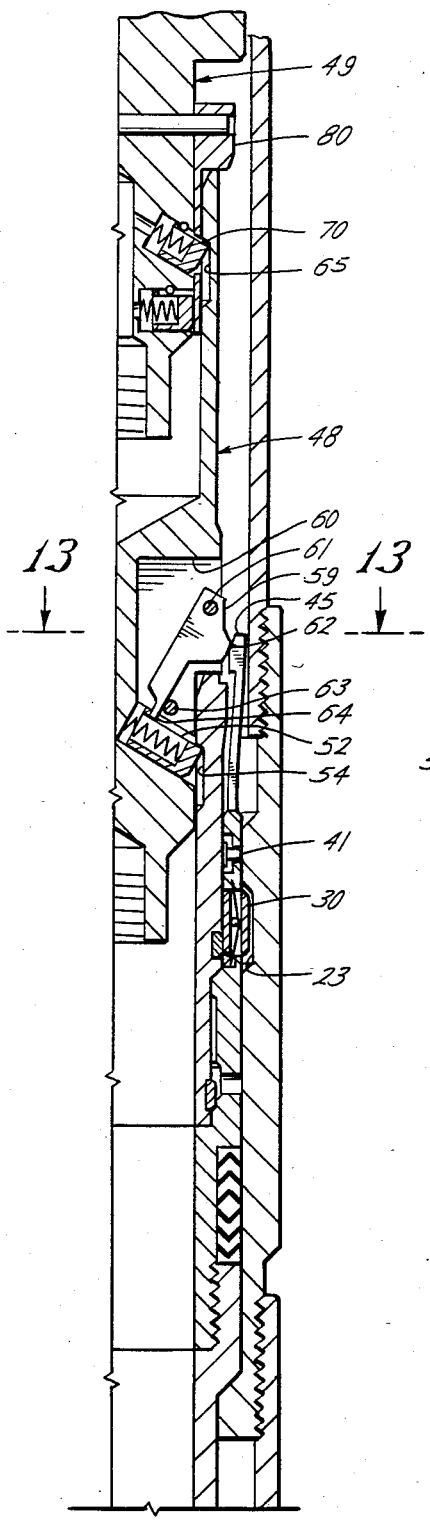
Figure 12A:
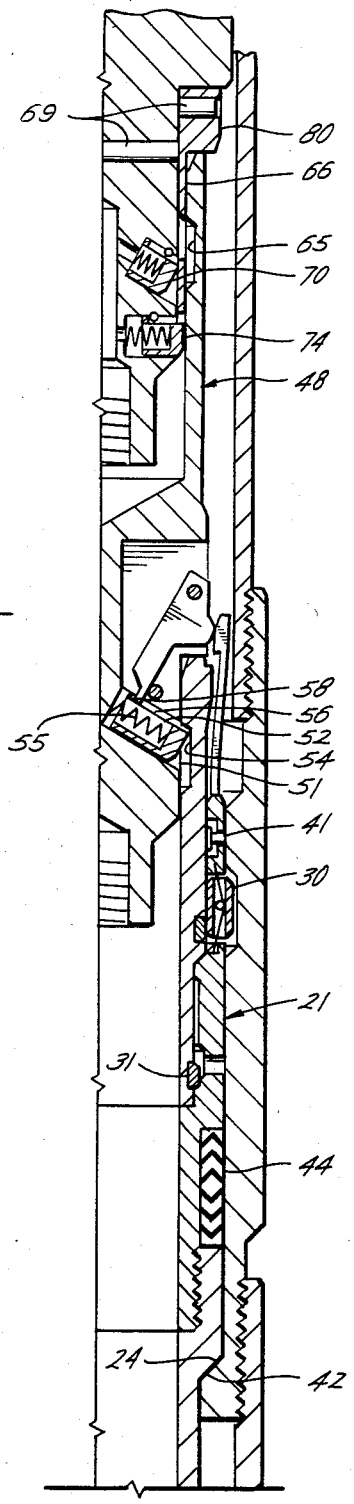
Figure 12B:
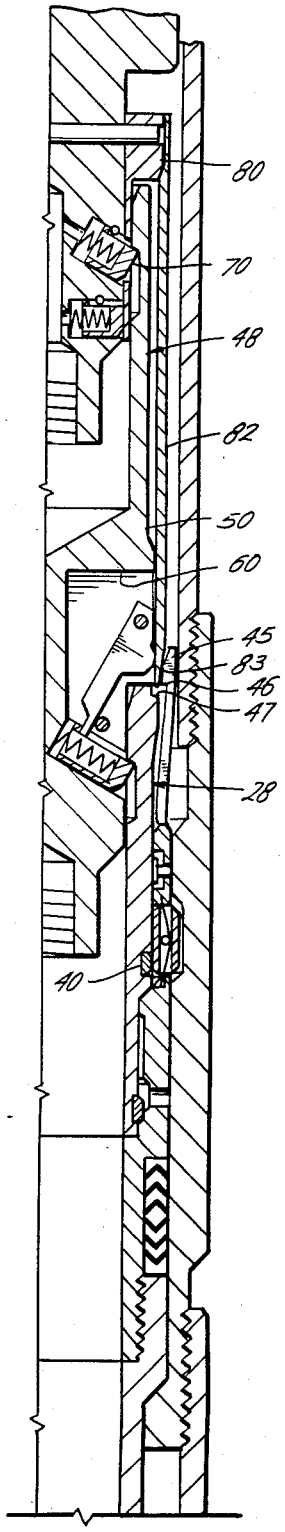
Figure 14:
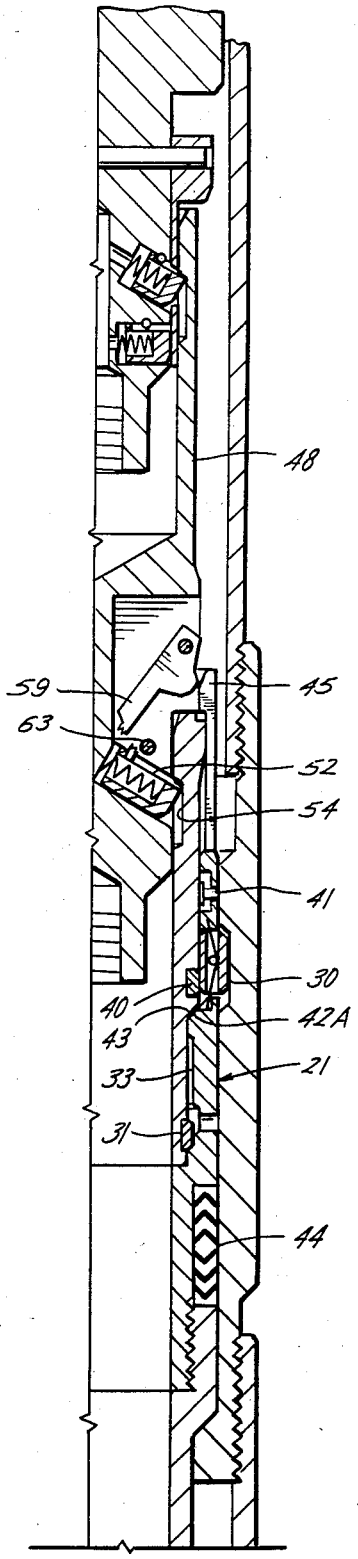
Figure 14A:
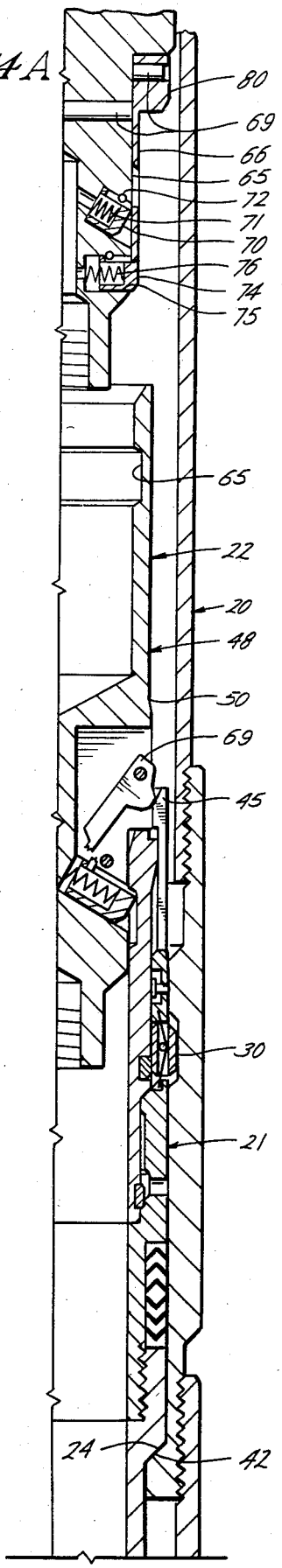
Figure 14B:
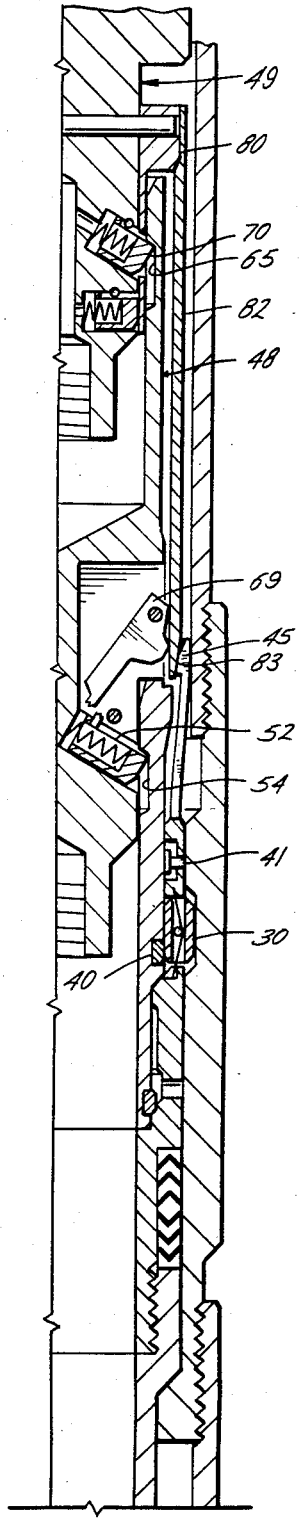

FIGS. 4 and 5 are cross sectional views, as seen along broken lines 4—4 and 5—5 of FIG. 1, and showing, respectively, the probes or sensors of the well tool and locking elements of the well tool as they move downwardly within the well conduit;

FIG. 6 is a partial vertical sectional view, similar to FIG. 1, but upon movement of the sensors into the predetermined cylindrical bore of the well conduit so as to release the first member of the well tool for downward movement with respect to the second member;

FIG. 7 is a partial vertical sectional view, similar to FIG. 6, but upon lowering of the first member with respect to the second member thereof to expand the locking elements into locking position within the groove of the well conduit, and cause shoulders on the collet fingers of the second member to move into locking position above the shoulder on the first member and thus pivot the dogs of the locking tool in a direction to move the latches of the running tool out of latching position within the latching groove of the first member of the well tool;

FIG. 8 is a cross sectional view of the running tool, as seen along broken lines 8—8 of FIG. 7, and showing the engagement of the upper ends of certain of the collet fingers with the dog of the lower running tool;

FIG. 9 is a partial vertical sectional view, similar to FIG. 8, but upon lifting of the running tool assembly from the well tool upon release of the latches of the lower running tool from the second member of the well tool;

FIG. 10 is another partical vertical sectional view of the apparatus including the well conduit with the well tool locked therein, as shown in FIG. 9, but following retrieval of the running tool assembly and lowering of the upper running tool thereof into connection with the well tool so as to force the collet fingers out of locking position;

FIG. 11 is a partial sectional view, similar to FIG. 10, but upon raising of the running tool to retrieve the well tool by lifting the first member with respect to the second member thereof so as to permit the locking elements of the well tool to retract;

FIG. 12 is another partial sectional view, similar to that shown in FIG. 7, but illustrating a possible malfunction of the apparatus in that at least certain of the collet fingers opposite one of the dogs of the running tool have not been sprung inwardly, so that the latches of the lower running tool have not been moved to unlatching position;

FIG. 12A is a partial sectional view similar to FIG. 12, but upon downward jarring of the upper running tool so as to retract its latches from latching position within the fishing neck of the lower running tool, whereby the upper running tool may be retrieved with the wireline;

FIG. 12B is another partial sectional view similar to FIG. 12A, but upon removal, and subsequent lowering of such running tool, when undressed, to dispose a sleeve carried thereby between the dogs of the lower running tool and the upper ends of any of the collet fingers which may have sprung inwardly to locking position, whereby the first member of the well tool may be lifted with the lower running tool and the upper running tool so as to release the locking elements of the well tool and thus permit its retrieval from the well conduit;

FIG. 13 is a cross sectional view, as seen along broken lines 13—13 of FIG. 12, and showing certain of the collet fingers moved inwardly to locking position, but other collet fingers opposite a dog of the lower running tool in outer positions, as shown in FIG. 12;

FIG. 14 is another partial sectional view, similar to FIG. 12, but illustrating another possible malfunction of the apparatus wherein the end of at least one of the dogs of the lower running tool has been sheared from the remainder thereof, so that the latch of the running tool remains in latched position;

FIG. 14A is a partial sectional view similar to FIG. 14, but upon release of the emergency release running tool from the lower running tool to permit its retrieval therefrom; and FIG. 14B is another partial sectional view, similar to FIG. 14A, but following retrieval of the upper running tool to permit it to be redressed and the aforementioned sleeve mounted thereon, and then lowered to move the sleeve into position to expand any collet fingers of the well tool which had not been moved to unlocking position, whereby the well tool may be retrieved with the upper running tool, as in FIG. 12B.

With reference now to the details of the above described drawings, the well tool, which is indicated in its entirety by reference character 21, is shown in FIG. 1 as it is lowered into the well conduit 20, which is a landing nipple connected as a part of a well string within a well bore, by means of a running tool assembly 22 suspended on a wire line. In the absence of a malfunction, and upon manipulation of the running tool assembly, in a manner to be described, the well tool is caused to be locked within the well conduit and the running tool assembly is released from the well tool, as shown in FIG. 7, to permit retrieval from the well conduit. At some later date, the well tool may be unlocked from the well conduit and retrieved therefrom by means of a retrieving tool, as shown in FIGS. 10 and 11.

As previously described, the well conduit has a locking groove 23 thereabout, a seat 24 below the groove, and a cylindrical bore 25 above the groove. As in the case of my prior co-pending application, the diameter of the bore 26 above the bore 25 is enlarged and of generally the same diameter as the well string above the well conduit, to permit the well tool to move freely into and out of locked positions within the well conduit. The bore 27 of the well conduit beneath the locking groove 23 is polished to provide a surface with which seal means carried by the well tool may sealably engage.

The well tool 21 is similar to that shown and described in my prior application in that it includes a body made of a first tubular member 28 adapted for releasable connection to the running tool assembly 22, and a second tubular member 29 which is supported by the first tubular for relative vertical movement therewith. As shown, the lower end of the first member extends within the upper end of the first member, and locking elements or keys 30 are carried by the second member for radial expansion and contraction with respect thereto generally opposite the lower end of the first member.

As shown in FIG. 1, during lowering of the well tool into the well conduit, the second member 29 is supported from the first tubular member 28 by means of a C-ring 31 carried about the lower end of the first tubular member beneath a downwardly facing shoulder 32 on the inner diameter of the second tubular member. As shown, the inner diameter of the second tubular member is recessed at 33 beneath the shoulder 31 so that, upon landing of the second tubular member, as shown in FIG. 6, the C-ring on the first tubular member is free to move downwardly within the recess as the first tubular member is lowered with respect to the second member in order to move the locking elements into locking position, as shown in FIG. 7.

As best shown in FIG. 5, each of the locking elements 30 is mounted for radial movement within a window 34 formed in the second tubular member, and is normally urged inwardly to retracted position by means of springs 35, as more fully described in my prior application. When the second member is supported from the first member, as the tool is lowered into the well bore, the locking elements are opposite a reduced lower outer diameter portion 36 of the first member, as shown in FIGS. 1, 5 and 6, so that they are held by the springs 35 in retracted positions in which their outer diameters are substantially aligned with the outer diameter of the second member of the well tool, and thus in positions in which they do not interfere with running of the well tool.

The upper end of the first tubular member 28 has a conical shoulder 42A just above the upper ends of the locking elements 30, when the second member is supported from the first member during lowering of the well tool and an enlarged outer diameter 36A above the shoulder. As will be described to follow, upon landing of the well tool to dispose the locking elements opposite the locking groove 23 of the well conduit, as shown in FIG. 6, the first tubular member is lowered with respect to the second member to cause the shoulder 42A to wedge the locking elements outwardly into locking position within the groove 23. Then, upon further lowering of the first member, the enlarged diameter 36A of the first member moves within the locking elements to hold them in locking position, as shown in FIG. 7. As shown in FIG. 5, flanges on opposite sides of the locking elements engage overhanging flanges on the second member to retain the locking dogs within the windows.

During lowering of the well tool into the well conduit, a C-ring 38 carried within a groove 39 about the first tubular member is normally expanded into a recess 40 on the inner diameter of the second member so as to bridge between the members and thereby hold the first member in its upper, extended position with respect to the second member. The C-ring 38 is adapted to be moved radially inwardly to a position out of the recess 40, and thus release the first member for downward movement with respect to the second member, by means of a plurality of sensing elements 41 in the forms of pins or buttons which are carried by the second tubular for radial movement within a circle of holes thereabout connecting the recess 40 with the outer diameter of the second member. Each such pin has a flange on its inner end which moves within the recess and which engages the bottom thereof so as to limit its outward movement to a sensing position in which its outer end extends beyond the outer diameter of the well tool, as shown in FIGS. 1 and 4.

The sensing elements move freely within the well string and the enlarged diameter 26 of the well conduit until they reach the conical shoulder 30*a* above cylindrical bore 25. As the well tool continues to be lowered, the sensing pins are cammed inwardly by the shoulder 30*a* and then slide downwardly into the cylindrical bore 25 beneath the shoulder. As the sensing elements are so moved, their flanged outer ends will force the C-ring 38 back into the groove 39, as shown in FIG. 6, and thus out of the recess 40 so as to release the first member for downward movement with respect to the second member.

Upon continued lowering of the well tool, a downwardly facing shoulder 42 about the second member will land upon the seat 24 of the well conduit, so that further downward movement of the running tool will lower the first member with respect to the seated second member to cause the shoulder 42A thereabout to cam the locking elements 30 outwardly into locking position within groove 23, and the enlarged outer diameter 36A of the first member to move behind the locking elements and thus hold them in locking position. At this time, the shoulder 42A about the first tubular member lands upon a conical shoulder 43 on the inner diameter of the second tubular member so as to limit further downward movement with respect thereto. As shown, a packing assembly 44 carried about the second tubular member has moved into the seal bore 27 to establish a seal between the well tool and well conduit.

As will be described to follow, and as previously mentioned, the well apparatus of the present invention is similar to that of my prior application in that the first member is held in its lower position with respect to the second member, and thus the locking elements 30 are held in locking position, and the running tool assembly 22 is released from the well tool automatically in response to lowering of the running tool assembly to lower the first member into the position described. However, as compared to the apparatus of my prior application, the first member is locked against movement in an upward direction—and thus in the direction opposite to that in which it has been moved with respect to the second member—by an upwardly directed force, and the running tool assembly is released from the well tool only when the first member is so locked, and thus not merely in response to its movement downwardly to locking position.

Thus, the upper end of the first member 28 comprises a series of closely spaced apart collet fingers 45 which closely surround the outer diameter of the first member 28. The upper ends of the collet fingers have enlarged inner diameters which form downwardly facing shoulders 46 thereon, and the outer diameter of the upper end of the first member is tapered upwardly and outwardly so that the upper ends of the collet fingers are biased or sprung outwardly as the first member moves downwardly with respect to the second member. An upwardly facing shoulder 47 is formed about the upper end of the first member in such a position that the shoulders 46 of the collet fingers spring inwardly over shoulders 47 just prior to downward movement of the first member to the position of FIG. 7 in which it holds the locking elements 30 in locking position. Preferably, the shoulders are parallel to one another and extend downwardly and inwardly at a slight angle with respect to the horizontal, so that, as above noted, the first member cannot be moved out of locking position by means of an upwardly directed force, and instead, can be unlocked from the second member only by an outwardly radially directed force against the upper ends of the collet fingers so as to move the shoulders 46 radially outwardly of the shoulder 47, as will be described to follow.

As previously described, running tool assembly 22 comprises a lower running tool 48 which is releasably connected to the first member 28 of the well tool for lowering the well tool into locked position, and an upper running tool 49 which is releasably connected to the lower running tool 48 so as to lower it and thus the well tool. For reasons previously mentioned, and to be described in detail to follow, the running tool 48 may be released from tool 49 to permit it to be retrieved from the well conduit in the event of a malfunction. As also previously mentioned, and as will also be described in detail, the running tool 49 may, following retrieval with tool 48 following locking of the well tool, be used in retrieving the well tool from locked position.

Running tool 48 includes a body 50 having a lower end 51 of reduced diameter adapted to fit closely within the upper end of first tubular member 28, and a series of radially spaced apart latches 52 carried within slots 53 in the sides of the lower end 51 of the running tool for movement into and out of a locking position within a groove 54 about the inner diameter of the first member. This much of running tool 48 is similar in many respects to the running tool shown and described in my co-pending application, Ser. No. 536,276 entitled "Wire Line Running and/or Pulling Tool", and filed Sept. 27, 1983. Thus, the slots 53 are arranged as to guide the latches 52 for sliding along paths extending downwardly and outwardly with respect to the axis of the running tool between inner positions in which the outer ends of the latches are removed from the groove 54 and outer positions in which the outer ends of the latches extend into the groove just beneath the upper end thereof. More particularly, the latches are yieldably urged to their outer positions by means of coil springs 55 compressed between them and the outer ends of the slots.

As described in more detail in my above-identified co-pending application, Ser. No. 536,276 the running tool 50 is releaseably connected to the well tool by moving its reduced diameter lower end 51 into the upper end of the tubular member until the latches are spring outwardly into the latched position of FIG. 1. Due to the arrangement of their bearing surfaces engageable with the lower sides of the slots and upper end of groove 54, the forces on the latches are equal and opposite so that friction forces, together with the force of spring 55 prevent the latches from moving inwardly and thus releasing the well tool as the well tool is raised or lowered into locked position within the well conduit.

The upper side of each latch has a flat 56 formed thereon for a distance inwardly from its outer ends up to and outwardly facing shoulder 58. Dogs 59 are mounted within slots 60 in the sides of the running tool that intersect at their lower ends with the upper ends of the slots 53 for the latches 51 for pivoting on a pin 61 extending through a hole in the body and thus across the slot 60 near its upper end. The outer side 62 of each dog is located in an outwardly projecting position with respect to the outer diameter of the running tool by means of another pin 63 extending through another hole in the body and thus across the lower end of the slot just above its intersection with slot 53. More particularly, each dog has an ear 64 on its lower end which extends into the flat 56 outwardly of the outwardly facing shoulder 58 on the latch.

As will be understood from a comparison of FIGS. 6 and 7, the outer sides 62 of the dogs are in a position to be engaged by the inner sides of the upper enlarged heads of the collet fingers 45 and thus swung in a clockwise direction from the positions of FIG. 6 to the position of FIG. 7, as the first member moves downwardly with respect to the second member to a position for locking the dogs 30 in the groove of the well conduit. Thus, the ears 64 on the ears 64 of the dogs are urged unwardly to bear against the shoulders 58 on the latches and overcome the force of the springs 52 to move the latches to the retracted position of FIG. 7. As shown in FIG. 7, with the latches held in their retracted positions, the running tool assembly need merely be lifted by the wireline for retrieval with respect to the well tool. Thus, the outer sides of the dogs will continue to be urged inwardly to retain the latches in retracted positions until their inner ends have moved into the inner diameter of the first member of the well tool above the groove 54.

It will be understood that the springs serve not only to yieldably urge the latches toward latching position, but also urge the lower ends of the dogs downwardly against the pins 63 and thus to dispose the outer sides of the dogs in position to be engaged and swung inwardly by the enlarged upper ends of the collet fingers of the second member of the well tool. Also, the ears 64 of the dogs serve to retain the latches within their slots when in their outer latching means.

As shown in FIG. 8, the spacing between the collet fingers is considerably less than the width of the locking dogs 59 so that the dogs cannot move between them. As also shown, there are two such locking dogs and thus two latches, although there may be a greater number of dogs and thus a corresponding number of latches if desired. As will also be understood, the running tool 48 and the first and second members of the well tool do not have to be connected in any predetermined circumferential relation.

In the event the well tool is properly locked within the well conduit, as above described, the entire running tool assembly 22 including the running tools 48 and 49 are retrieved from the well conduit by raising of the wire line connected to the upper running tool 49. The upper running tool is of such construction that, when the running tool assembly is retrieved, it may be released from the lower running tool at some later date. Thus, it is connectible to the running tool 48 and then lowered back into the well conduit for the purpose of retrieving the well tool 48 in much the same manner that running tool 48 is releasably connected to the well tool. Also, the running tool 49 is preferably of a construction corresponding to that described in my prior application, Ser. No. 536,276, and thus is adapted to be released from the lower running tool in the manner described.

Similarly to the running tool 48, the running tool 49 has a reduced diameter lower portion which is adapted to fit closely within the upper diameter of a hollow upper portion of body 50 of the running tool 48 so as to permit latches 70 carried within slots about the lower portion to be moved into latching position within a latching groove 65 in the running tool 48. As in the case of the running tool of my co-pending application, Ser. No. 536,276, it includes a body 66 having a lower, reduced outer diameter portion which is surrounded by a sleeve 67 adapted to fit closely within the inner diameter of the upper end of running tool 48. More particularly, windows 68 are formed in the sleeve, and the sleeve is releasably connected to the body 65 by means of a shear pin 69 to arrange the windows opposite the outer ends of the latches. As shown in my co-pending application, Ser. No. 536,276 and as in the case of latches 51 of tool 48, the slots are so arranged as to guide the latches for movement downwardly and outwardly with respect to the axis of the tool.

The latches are yieldably urged to outer positions in which they extend through the windows and into the groove 65 by means of springs 71 compressed between the latches the outer ends of the slots. The latches are retained within the slots by means of pins 72 extending through the body and thus across flats on the upper sides of the latches outwardly of a stop shoulder on the latches adjacent the outer ends of the flats. As will be appreciated, especially in the light of my co-pending application, Ser. No. 536,276, the running tool 49 may be assembled in latching position with respect to running tool 50 merely by moving the lower end thereof into the upper end of the running tool 48 until the outer ends of the latches slide downwardly along the inner diameter of the upper end of the recess in the tool 50 and into positions opposite the upper ends of the grooves 65. As in the case of the latches of running tool 48, the bearing surfaces on the upper and lower sides of the latches are arranged as to prevent the latches from moving out of latching position as the lower running tool 48 and well tool are raised and lowered with the upper running tool 49.

Upon retrieval of the running tool assembly following locking of the well tool in the well conduit, running tool 49 may be disconnected from running tool 48 so as to permit it to be used in later retrieving the well tool, by removing the shear pin 69 and moving the body of the running tool into the sleeve 67 until cam surfaces on the lower edges of the windows 68 force the outer ends of the latches inwardly as they move downwardly with respect to the sleeve. Continued inward movement of the body with respect to the sleeve will then cause the inner diameter of the sleeve beneath the lower edges of the window to slide over the outer ends of the latches and thus retain them in unlatched position. As this occurs, a pin 74 carried within radially arranged slot 75 in the sides of the lower reduced diameter portion of the body of the running tool are yieldably urged by springs 76 from an inner position, as shown in FIG. 1, in which its outer end is within the sleeve 67, to an outer position in which its outer end is beneath the lower edge of the sleeve so as to prevent retrograde or outward movement of the body with respect to the sleeve, and thus prevent release of the latches 70 from within the sleeve.

To prepare it for use in retrieving the well tool, running tool 49 is redressed by depressing pin 74 to permit the body thereof to be moved outwardly with respect to the sleeve, and replacing shear pin 69. At this time, latches 70 are returned to their prior positions when the tool was first assembled with running tool 48, as shown in FIG. 1. In order to accommodate the use of the running tool 49 in retrieving the well tool, the groove 65 in the upper end of the body 50 of running tool 48 is of essentially the same configuration and location relative to the upper end of such body as is the groove 54 relative to the upper end of the first member 28 of the well tool. Thus, upon lowering the running tool 49 onto the upper end of the well tool, as shown in FIG. 10, the sleeve thereof will move closely within the upper end of the first member of the well tool, and the latches 70 will be urged inwardly to slide downwardly within the upper end of the first member until their outer ends are opposite the groove 54, and then to move outwardly into latched position within groove 54 to automatically connect the running tool to the well tool.

As in the case of the running tool in my prior application, Ser. No. 536,276, the upper end 80 of the sleeve is radially enlarged to provide a downwardly facing shoulder adapted to engage the upper end of the well tool to which the running tool is connected when the outer ends of the latches have been moved into the groove in the well conduit. In accordance with the present invention, however, this enlarged portion 80 has an outer diameter which is at least somewhat larger than the inner diameter of the upwardly facing shoulder 47 on the upper end of the first member of the well tool. More particularly, the lower outer corner of the enlargement and the upper inner corner of the upper ends of the collet fingers 45 are tapered to permit the lower edge of the enlargement to wedge the upper ends of the collet fingers outwardly to the unlocking positions shown in FIG. 10 as the retrieving tool is lowered into latching position with respect to the well tool. The outer diameter of the enlargement 80 will hold the shoulders 46 on the ends of the collet fingers radially outwardly of the shoulders 47 on the upper end of the first member as the wireline is raised to lift the first member with respect to the second member a distance sufficiently to move shoulder 47 above the shoulders 46.

Thus, as shown in FIG. 11, the first member is free to continue to move upwardly with the retrieving tool to a position in which shoulder 35 moves above the locking element 30 to permit them to be retracted inwardly to the unlocking positions of FIG. 11 and the groove 40 in the first member has moved opposite the C-ring 38 so as to permit the C-ring to spring inwardly to a position bridging across the separation between the first and second members. More particularly, the C-ring 31 has moved upwardly to engage the downwardly facing shoulder 32 on the inner diameter of the second member so as to support the second member from the first member and thus permit the well tool to be retrieved with the tool 49.

As previously described, there are circumstances under which the apparatus may malfunction as by failure of the well tool to be locked within the groove of the well conduit, or upon failure of the first member to be locked against upward movement with respect to the second member, in which case the latches 51 are not moved to unlatching position to release the running tool assembly from the well tool. Or, even if the well tool is locked within the well conduit, and the first member is locked down with respect to the second member, the latches 51 may not move to unlatching position, and hence the running tool assembly may not be released from the well tool, in the event of malfunction of the running tool itself.

Of course, if the malfunction is due to the failure of the first member to move downwardly to its fully lowered position for moving the locking elements into locking position, the well tool need only be retrieved with the running tool assembly for inspection and repair as needed. That is, since it has not been locked in its lower position, the first member is free to move upwardly with respect to the second member as the wireline is raised. On the other hand, and even if the first member has been fully lowered to move the locking elements into the locking groove of the well conduit, the latches of the running tool 48 may not be moved to unlatching position. This may occur, for example, due to debris or other obstruction behind the locking dogs which prevent them from being swung in a clockwise direction by engagement of their outer sides 62 by the inner sides of the upper ends of the collet fingers. Alternatively, the collet fingers engageably with the outer sides of the dogs may, for some reason, have been sprung outwardly, even to a slight extent so that they are not operable to swing the dogs in a clockwise direction a sufficient distance to retract the latches. As will be understood, the running tool assembly will not be released from the well tool if this malfunction occurs with respect to any one or more of the dogs, and even though the first member is locked in its lower position by one or more of the collet fingers not engageable with the dogs.

In any case, in the event of malfunction for any one ore more of these reasons, running tool 49 is released from the running tool 48 to permit recovery of the wire line, and, for this purpose, and as more fully described in my co-pending application, Ser. No. 536,276, the running tool 49 is jarred downwardly the shear pin 69 and thus permit the lower reduced diameter portion of the running tool to be moved downwardly with respect to the sleeve which, of course, is held against downward movement by engagement of the shoulder on the lower side of its enlargement 80 with the upper end of the running tool body 50. As described in connection with the assembly of the running tool 49 with the running tool 48, this downward movement of the body of the running tool 49 will cam the latches 70 to their inner positions within the sleeve, and then retain them in such inner positions as the sleeve moves over their outer ends as the body moves downwardly to a position to release pin 74. At this time, the latches are retained with the sleeve and the running tool 49 may be lifted on the wireline to retrieve it from the running tool 48.

Upon retrieval, running tool 49 may be redressed, in a manner previously described, and a sleeve 82 is connected to its enlargement 80 for depending therefrom to a level substantially beneath its lower end. More particularly and as shown in FIG. 12B, the sleeve is of such length and diameter that, upon lowering of the tool 49 back into the well conduit to reconnect it to the upper end of the running tool 48, sleeve 82 will pass downwardly over the outer diameter of the upper end of the running tool 48 and within the inner sides of the collet fingers 45 of the second member of the well tool. More particularly, the lower outer side 83 of the sleeve 82 is tapered downwardly and inwardly so it will cam the upper ends of the collet fingers which have been moved into locking positions out of such positions to move the shoulders 46 thereon radially outwardly of the upwardly facing shoulder 47 on the upper end of the first member. More particularly, the lower end of the sleeve 82 holds the locking fingers in unlocking position until the first member has been raised sufficiently to move the shoulder 47 on its upper end above the downwardly facing shoulders 46 on the upper ends of the collet fingers, and thus permit the first member to be raised with respect to the second member to release the locking elements and to retrieve the well tool with the running tool 48 and modified running tool 49.

As previously described, the apparatus may also malfunction in the event one or both of the dogs 59 breaks intermediate the ear on its lower end and the upper pivot pin 61. In this event, as shown in FIG. 14, at least the latch 51 associated with that dog will remain in latched position, thereby preventing the running tool 48 from being retrieved. In this case, the running tool 49 is jarred downwardly to release it from the running tool 48 then retrieved therefrom, as illustrated in FIG. 14A. Then, as described in connection with FIG. 12B, the running tool 49 may be redressed and fitted with the sleeve 82, so that, upon lowering of the running tool into connection with the first member of the well tool, the upper ends of any of the collet fingers which have been moved to locked position are forced to unlocking position to permit the running tool 48 to be moved upwardly with the running tool 49 to release the well tool from locking position and retrieve it from the well conduit.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpretated as illustrative and not in a limiting sense.

The invention having been described, what is claimed is:

1. For use in a well conduit having a seat therein and an internal groove thereabout, apparatus comprising a running tool adapted to be raised and lowered within the well conduit, a well tool, means for connecting the well tool to the running tool to permit the well tool to be raised and lowered with the running tool, locking means carried by the well tool for radial expansion and contraction with respect thereto, said well tool having a shoulder thereon engageable with the seat to dispose the locking means opposite the groove in the well conduit, means shiftable in one vertical direction, following engagement of the shoulder with the seat, for causing the locking means to be expanded into locking position within the groove, and means operable upon further shifting of said shiftable means in said one vertical direction, following expansion of said locking means into locking position, for locking said shiftable means against movement in the opposite direction in response to an axial force in said opposite vertical direction, and means automatically responsive to locking of said shiftable means for disconnecting the running tool from the well tool in order to permit retrieval of the running tool from the well conduit.

2. Apparatus of the character defined in claim 1, wherein the means for connecting the well tool to the running tool comprises a groove in the well tool, and latches carried by the running tool and yieldably urged to positions for latching within the groove, and the means for disconnecting the well tool from the running tool comprises means for moving said latches to unlatching position.

3. Apparatus of the character defined in claim 2, wherein the means for locking said shiftable means includes means which is radially biased into locking position and which engages said latch moving means to disconnect said running tool and well tool automatically in response to further movement of said shiftable means in said one vertical direction.

4. Apparatus of the character defined in claim 3, wherein said latch moving means comprises dogs which are carried by the running tool.

5. Apparatus of the character defined in claim 3, including another tool adapted to be raised and lowered within the well conduit, said other tool having means for releasably connecting it to the running tool, when lowered onto said running tool, and means for unlocking said shiftable means and/or disconnecting the running tool, as said other tool is so lowered, whereby said well tool and running tool may be raised with said other tool in order that the well tool may be retrieved in the event said shiftable means is not unlocked and/or the running tool is not disconnected upon said further shifting of said shiftable means, said unlocking and/or disconnecting means on said other tool comprising means movable between said biased means and latch moving means.

6. Apparatus of the character defined in claim 1, including another running tool connectible to a wire line for raising and lowering therewith, and means for connecting the other running tool to the first-mentioned running tool, said connecting means being releasable to permit said other running tool to be retrieved in the event the first-mentioned running tool cannot be disconnected from the well tool.

7. Apparatus of the character defined in claim 6, wherein the other running tool has means thereon for connecting it to said well tool, following retrieval of both running tools and subsequent lowering of the other running tool onto the well tool, and for unlocking said shiftable means as said other running tool is so lowered into connection with the well tool, whereby said well tool may be moved with said other running tool in said other vertical direction to release the locking means and permit said well tool to be retrieved with the other running tool.

8. Apparatus of the character defined in claim 7, wherein the means for connecting each running tool to the well tool comprises a groove in the first member, latches carried by each running tool and yieldably urged to positions for latching within the groove, and the means for disconnecting the well tool and the first-mentioned running tool comprises means for moving said latches to unlatching position.

9. Apparatus of the character defined in claim 1, including another tool adapted to be raised and lowered within the well conduit, said other tool having means thereon for connecting it to said well too, following retrieval of the running tool and subsequent lowering of the other tool onto the well tool, and for unlocking said shiftable means, as said other tool is so lowered, whereby said well tool may be moved with said other tool in said other vertical direction to release the locking means and permit said well tool to be retreived with the other tool.

10. Apparatus of the character defined in claim 9, wherein the means for locking the shiftable means includes means which is radially biased into locking position, and said means on the other tool for unlocking said shiftable means comprises means engageable with the radially biased means to move it out of locking position.

11. Apparatus of the character defined in claim 10, including another tool adapted to be raised and lowered within the well conduit, said other tool having means for releasably connecting it to the running tool, when lowered onto said running tool, and for unlocking said shiftable means and/or disconnecting the running tool, as said other tool is so lowered, whereby said well tool and running tool may be raised with said other tool in order that the well tool may be retrieved in the event said shiftable means is not unlocked and/or the running tool is not disconnected upon said further shifting of said shiftable means.

12. Apparatus of the character defined in claim 11, wherein said means for unlocking said shiftable means is removable from the remainder of said other tool, and said other tool has means thereon for releasably connecting it to said running tool so that, with said unlocking means removed; said running tool and the well tool may be lowered with the other tool, and said other tool released and retrieved from the running tool in the event the running tool is not released from said well tool member.

13. Apparatus of the character defined in claim 12, wherein said other tool has means thereon for connecting it to said well tool, following retrieval of the running tool and subsequent lowering of the other tool onto the well, and for unlocking said shiftable means, as said other tool is so lowered, whereby said well tool may be moved with said other tool in said other vertical direction to release the locking means and permit said well tool to be retrieved with the other tool.

14. Apparatus of the character defined in claim 1, wherein the shoulder on the well tool is landable on an upwardly facing seat in the well conduit, and the shiftable means is lowered to cause the locking means to be expanded and the shiftable means to be locked.

15. For use in a well conduit having a seat therein and an internal groove thereabout, apparatus comprising a running tool adapted to be raised and lowered within the well conduit, a well tool including a first member, a second member supported by the first member for vertical movement with respect thereto, means for connecting the first member to the running tool to permit the well tool to be raised and lowered therewith, said second member having a shoulder thereon engageable with the seat to prevent further movement of a said second member in one vertical direction, locking means carried by the second member for disposal opposite the groove in the well conduit when the shoulder is engaged with the seat in the well conduit, said first member having means thereon for moving the locking means into locking position within the groove in response to vertical movement of the first member in one vertical direction with respect to the second member, said first and second members having parts thereon which are automatically movable into locking positions, upon further movement of said first member in said one vertical direction, following movement of the first member in the opposite vertical direction in response to an axial force in the opposite vertical direction, and means responsive to movement of said parts into locking position for disconnecting the running tool assembly and first member in order to permit retrieval of said running tool from the well conduit.

16. Apparatus of the character defined in claim 15, wherein the means for connecting the first member to the running tool comprises a groove in the first member, and latches carried by the running tool and yieldably urged to positions for latching within the groove, and the means for disconnecting the first member and running tool assembly comprises means for moving said latches to unlatching position.

17. Apparatus of the character defined in claim 16, wherein the port on one of said members is radially biased into locking position and engages said latch moving means to disconnect said running tool and well tool, automatically in response to further movement of said first member in said one vertical direction.

18. Apparatus of the character defined in claim 17, wherein said latch moving means comprises dogs which are carried by the running tool.

19. Apparatus of the character defined in claim 17, including another tool adapted to be raised and lowered within the well conduit, said other tool having means for releasably connecting it to the running tool, when lowered onto said running tool, and means for disengaging those parts which have moved into engagement with one another and thereby release said first member from said second member, and/or disconnecting said running tool, as said other tool is so lowered, whereby said first member and running tool may be raised with said other tool in order that the well tool may be retrieved in the event said first member is not released and/or the running tool is not disconnected upon said further movement of said first member, said unlocking and/or disconnecting means on said other tool comprising means movable between said baised means and latch moving means.

20. Apparatus of the character defined in claim 15, including another running tool connectible to a wire line for raising and lowering therewith, and means for connecting the other running tool to the first-mentioned running tool, said connecting means being releasable to permit said other running tool to be retrieved in the event the first-mentioned running tool cannot be disconnected from the well tool.

21. Apparatus of the character defined in claim 20, wherein the other running tool has means thereon for connecting it to said first member, following retrieval of both running tools and subsequent lowering of the other running tool onto the first member, and for moving said parts out of engagement with one another, as said other running tool is so lowered into connection with the first member, whereby said first member may be moved with said other running tool in said other vertical direction to release the locking means and permit said well tool to be retrieved with the other running tool.

22. Apparatus of the character defined in claim 21, wherein the means for connecting each running tool to the first member comprises a groove in the first member, latches carried by each running tool and yieldably urged to positions for latching within the groove, and the means for disconnecting the first member and the first-mentioned running tool comprises means for moving said latches to unlatching position.

23. Apparatus of the character defined in claim 15, including another running tool adapted to be raised and lowered within the well conduit, said other tool having means thereon for connecting it to said first member, following retrieval of the running tool and subsequent lowering of the other running tool onto the first member, and for moving said parts out of engagement with one another, as said other tool is so lowered, whereby said first member may be moved with said other tool in said other vertical direction to release the locking means and permit said well tool to be retrieved with the other tool.

24. Apparatus of the character defined in claim 23, wherein the locking part on one of said members is radially biased into locking position, and said means on the other tool comprises means engageable with the radially biased part on said one member to move it out of locking position with said other part

25. Apparatus of the character defined in claim 15, including another tool adapted to be raised and lowered within the well conduit, said other tool having means for releasably connecting it to the running tool, when lowered onto said running tool, and for disengaging those parts which have moved into engagement with one another and thereby release said first member from said second member, and/or disconnecting said running tool, as said other tool is so lowered, whereby said first member and running tool may be raised with said other tool in order that the well tool may be retrieved in the event said first member is not released and/or the running tool is not disconnected upon said further movement of said first member.

26. Apparatus of the character defined in claim 25, wherein said means for disengaging said parts is removable from the remainder of said other tool, and said other tool has means thereon for releasably connecting it to said running tool so that, with said additional means removed, said running tool and the well tool may be lowered with the other tool, and said other tool released and retrieved from the running tool in the event it is not released from said first member.

27. Apparatus of the character defined in claim 26, wherein said other tool having means thereon for connecting it to said first member, following retrieval of the running tool and subsequent lowering of the other tool onto the first member, and for moving said parts out of engagement with one another, as said other tool is so lowered, whereby said first member may be moved with said other tool in said other vertical direction to release the locking means and permit said well tool to be retrieved with the other tool.

28. Apparatus of the character defined in claim 15, wherein the shoulder on the second member is landable on an upwardly facing seat in the well conduit, and the first member is lowered with respect to the member to expand the locking means and cause the first member to be locked to the second member.

29. For use in a well conduit having a seat therein and an internal groove thereabout, apparatus comprising a running tool adapted to be raised and lowered within the well conduit, a well tool including a first member, a second member supported by the first member for vertical movement with respect thereto, means for connecting the first member to the running tool to permit the well tool to be raised and lowered therewith, said second member having a shoulder thereon engageable with the seat to prevent further movement of said second member in one vertical direction, locking means carried by the second member for disposal opposite the groove in the well conduit when the shoulder is engaged with the seat in the well conduit, said first member having means thereon for moving the locking means into locking position within the groove in response to vertical movement of the first member in one vertical direction with respect to the second member, one member including collet fingers having shoulders which are radially biased by the other member, as said first member is moved in said one direction with respect to the second member, the other member having oppositely facing shoulder over which the shoulders on the collet fingers move upon further movement of said first member in said one vertical direction, following movement of the first member in the opposite vertical direction in response to an axial force in the opposite vertical direction, and means responsive to movement of the collet finger shoulders over the shoulder on the first member for disconnecting the running tool from the first member to permit retrieval of the running tool.

30. Apparatus of the character defined in claim 29, wherein the means for connecting the first member to the running tool comprises a groove in the first member, and latches carried by the running tool and yieldably urged to positions for latching within the groove and, the means for disconnecting the first member and running tool comprises means for moving the latches to unlatching position, and means on each collet finger for moving a latch to unlatching position as the shoulder thereof moves over the shoulder on the other member.

31. Apparatus of the character defined in claim 30, wherein said latch moving means comprises dogs which are carried by the running tool.

32. Apparatus of the character defined in claim 30, including another tool adapted to be raised and lowered within the well conduit, said other tool having means for releasably connecting it to the running tool, when lowered onto said running tool, and for moving the shoulders of the collet fingers from over the shoulder on said other member, and/or disconnecting said running tool, whereby said first member and running tool may be raised with said other tool in over to retrieve the well tool in the event the collet fingers are not so moved from over the shoulder on said other member and/or the running tool is not disconnected upon said further movement of the first member.

33. Apparatus of the character defined in claim 30, wherein said means for moving the shoulders of the collet fingers and/or disconnecting means comprises means moveable between the collet finger shoulders and latch moving means.

34. Apparatus of the character defined in claim 29, including another tool adapted to be raised and lowered within the well conduit, said other tool having means thereon for connecting it to said first member, following retrieval of the first-mentioned running tool and subsequent lowering of the other tool onto the first member, and for moving said collet fingers to positions in which the shoulders thereon are radially displaced from the shoulder on the other member, as said other tool is so lowered, whereby said first member may be moved with said other tool in said other vertical direction to release the locking means and permit said well tool to be retrieved with the other tool.

35. Apparatus of the character defined in claim 30, wherein the running tool includes a body on which the latches are carried, and dogs pivotally mounted on the body to dispose one end of each for engaging a latch and the other end for engagement by a collet finger to pivot the dogs in a direction to unlatch the latches.

36. Apparatus of the character defined in claim 35, including spring means compressed between each latch and running tool body to yieldably urge the latch to latching position and the other end of the dog into position for engagement by a collet finger.

37. Apparatus of the character defined in claim 35, wherein there are a lesser number of dogs than collet fingers so that only certain fingers are engageable with the dogs.

38. Apparatus of the character defined in claim 35, wherein the dogs are engaged by portions of the collet fingers above the shoulder thereon which extend above the other member.

39. Apparatus of the character defined in claim 38, wherein the collet fingers surround the other member.

40. Apparatus of the character defined in claim 29, wherein the shoulder on the second member is landable no an upwardly facing seat in the well conduit, and the first member is lowered with respect to the second member to expand the locking means and cause the first member to be locked to the second member.

41. A running tool, comprising a body adapted to raised and lowered within a well conduit, latches carried by the body and yieldably urged to positions for latching within a groove of a well tool having a first member which is vertically shiftable with respect to another member thereof which is landed within the conduit, and dogs mounted on the body to dispose one end of each for engaging a latch and the other end for engagement by a part on the other member of the well tool as the first member is shifted vertically with respect thereto in order to move the latches to unlatching position.

42. A running tool of the character defined in claim 41, including spring means compressed between each latch and the body to yieldably urge the latch to latching position and the other end of the dog into position for engagement by said part on said other member.

* * * * *